US007942759B2

(12) United States Patent
Matsunaga et al.

(10) Patent No.: US 7,942,759 B2
(45) Date of Patent: May 17, 2011

(54) GOLF CLUB HEAD

(75) Inventors: Hideo Matsunaga, Chichibu (JP); Makoto Kubota, Tokyo (JP); Masaomi Hiruta, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 103 days.

(21) Appl. No.: 11/930,626

(22) Filed: Oct. 31, 2007

(65) Prior Publication Data

US 2008/0139338 A1 Jun. 12, 2008

(30) Foreign Application Priority Data

Dec. 12, 2006 (JP) ..... 2006-334681

(51) Int. Cl.
*A63B 53/04* (2006.01)

(52) U.S. Cl. ..... 473/342; 473/345; 473/346

(58) Field of Classification Search ..... 473/324–350
See application file for complete search history.

(56) References Cited

U.S. PATENT DOCUMENTS

| | | | | |
|---|---|---|---|---|
| 1,582,836 | A * | 4/1926 | Link | 473/346 |
| 4,438,931 | A * | 3/1984 | Motomiya | 473/346 |
| 4,511,145 | A * | 4/1985 | Schmidt | 473/346 |
| 4,602,787 | A * | 7/1986 | Sugioka et al. | 473/338 |
| 5,295,689 | A * | 3/1994 | Lundberg | 473/346 |
| 5,346,217 | A | 9/1994 | Tsuchiya et al. | |
| 5,465,968 | A * | 11/1995 | Aizawa et al. | 473/342 |
| 5,547,188 | A | 8/1996 | Dumontier et al. | |
| 5,755,627 | A | 5/1998 | Yamazaki et al. | |
| 5,908,356 | A * | 6/1999 | Nagamoto | 473/224 |
| 5,941,782 | A * | 8/1999 | Cook | 473/346 |
| 5,961,394 | A * | 10/1999 | Minabe | 473/305 |
| 6,001,495 | A * | 12/1999 | Bristow et al. | 428/660 |
| 6,260,250 | B1 * | 7/2001 | Hall et al. | 29/281.1 |
| 6,340,337 | B2 * | 1/2002 | Hasebe et al. | 473/349 |
| 6,440,009 | B1 | 8/2002 | Guibaud et al. | |
| 6,508,722 | B1 * | 1/2003 | McCabe et al. | 473/330 |
| 6,595,871 | B2 | 7/2003 | Sano | |

(Continued)

FOREIGN PATENT DOCUMENTS

EP 1 757 337 A1 2/2007

(Continued)

OTHER PUBLICATIONS

United Kingdom Search Report dated Feb. 26, 2008.

(Continued)

*Primary Examiner* — Alvin A Hunter
(74) *Attorney, Agent, or Firm* — Sughrue Mion, PLLC

(57) ABSTRACT

A golf club head 1 has a face part 2, a crown part 3, a sole part 4, a side part 5, and a hosel part 6, which are formed of titanium or a titanium alloy. The golf club head 1 is formed by integrating a head body 10 and a face plate 30 with each other by welding such as laser welding or plasma welding. A thick part 20 is provided only in the central portion in the toe-heel direction of the cross corner portion between the face part 2 and the sole part 4. The width in the toe-heel direction of the thick part 20 is 20 mm or narrower. Therefore, the golf club head in accordance with the present invention can increase a carry on average even if being used by an amateur golfer who is prone to hit a ball by varied hit points across the clubface.

20 Claims, 5 Drawing Sheets

U.S. PATENT DOCUMENTS

| | | | | |
|---|---|---|---|---|
| 6,602,149 | B1 * | 8/2003 | Jacobson | 473/329 |
| 6,645,087 | B2 * | 11/2003 | Yabu | 473/342 |
| 6,669,577 | B1 * | 12/2003 | Hocknell et al. | 473/329 |
| 6,780,123 | B2 | 8/2004 | Hasebe | |
| 6,783,465 | B2 | 8/2004 | Matsunaga | |
| 6,949,031 | B2 | 9/2005 | Imamoto et al. | |
| 7,059,973 | B2 * | 6/2006 | Erickson et al. | 473/345 |
| 7,207,898 | B2 * | 4/2007 | Rice et al. | 473/329 |
| 7,232,381 | B2 | 6/2007 | Imamoto et al. | |
| 7,377,861 | B2 * | 5/2008 | Tateno et al. | 473/345 |
| 7,431,668 | B2 * | 10/2008 | Tateno et al. | 473/346 |
| 7,435,191 | B2 * | 10/2008 | Tateno et al. | 473/346 |
| 7,455,597 | B2 * | 11/2008 | Matsunaga | 473/329 |
| 7,513,836 | B2 * | 4/2009 | Matsunaga | 473/345 |
| 2001/0007837 | A1 | 7/2001 | Hasebe et al. | |
| 2002/0082117 | A1 | 6/2002 | Nishitani et al. | |
| 2002/0091015 | A1 | 7/2002 | Seki et al. | |
| 2004/0018889 | A1 | 1/2004 | Yamamoto | |
| 2004/0224785 | A1 | 11/2004 | Hasebe | |
| 2005/0124436 | A1 * | 6/2005 | Kakiuchi et al. | 473/345 |
| 2005/0245329 | A1 | 11/2005 | Nishitani et al. | |
| 2005/0250594 | A1 | 11/2005 | Nishitani et al. | |
| 2006/0111198 | A1 | 5/2006 | Matsunaga | |
| 2006/0111200 | A1 * | 5/2006 | Poynor | 473/346 |
| 2007/0032311 | A1 | 2/2007 | Kajita | |
| 2007/0275792 | A1 * | 11/2007 | Horacek et al. | 473/346 |
| 2008/0139338 | A1 * | 6/2008 | Matsunaga et al. | 473/346 |
| 2008/0220894 | A1 * | 9/2008 | Matsunaga et al. | 473/346 |
| 2008/0261719 | A1 | 10/2008 | Matsunaga | |

FOREIGN PATENT DOCUMENTS

| | | | | |
|---|---|---|---|---|
| JP | 61-249485 | A | | 11/1986 |
| JP | 04292178 | A | * | 10/1992 |
| JP | 04367678 | A | * | 12/1992 |
| JP | 05-029563 | A | | 4/1993 |
| JP | 06-343722 | A | | 12/1994 |
| JP | 08-126723 | A | | 5/1996 |
| JP | 08243194 | A | * | 9/1996 |
| JP | 09-154985 | A | | 6/1997 |
| JP | 11137733 | A | * | 5/1999 |
| JP | 11155982 | A | * | 6/1999 |
| JP | 11-216203 | A | | 8/1999 |
| JP | 2000-317018 | A | | 11/2000 |
| JP | 2000317018 | A | * | 11/2000 |
| JP | 2001-046559 | A | | 2/2001 |
| JP | 2001-070486 | A | | 3/2001 |
| JP | 2001-137396 | A | | 5/2001 |
| JP | 2001-187174 | A | | 7/2001 |
| JP | 2001212268 | A | * | 8/2001 |
| JP | 2002-119625 | A | | 4/2002 |
| JP | 2003-052866 | A | | 2/2003 |
| JP | 2003126311 | A | * | 5/2003 |
| JP | 2003210622 | A | * | 7/2003 |
| JP | 2003-265652 | A | | 9/2003 |
| JP | 2003-265653 | A | | 9/2003 |
| JP | 2004-041376 | A | | 2/2004 |
| JP | 2004065742 | A | * | 3/2004 |
| JP | 2004-187795 | A | | 7/2004 |
| JP | 2004-222792 | A | | 8/2004 |
| JP | 2004357978 | A | * | 12/2004 |
| JP | 2005-021649 | A | | 1/2005 |
| JP | 2005168665 | A | * | 6/2005 |
| JP | 2005253973 | A | * | 9/2005 |
| JP | 2001-353240 | A | | 12/2007 |

OTHER PUBLICATIONS

CN Office Action, Application No. 2007101428948, May 22, 2009.

* cited by examiner

GOLF CLUB HEAD

FIELD OF THE INVENTION

The present invention relates to a metallic hollow golf club head and, more particularly, to a large golf club head such as a driver.

BACKGROUND OF THE INVENTION

As a wood-type golf club head such as a driver and a fairway wood, a metallic hollow golf club head has been used widely. Generally, the hollow wood-type golf club head comprises a face part for hitting a ball, a crown part constituting the top surface portion of the golf club head, a sole part constituting the bottom surface portion of the golf club head, a side part constituting the side surface portions on the toe side, back side, and heel side of the golf club head, and a hosel part. In this hosel part, a shaft is inserted and fixed by an adhesive or the like.

As a metal forming the hollow golf club head, an aluminum alloy, stainless steel, or titanium alloy has been used, and especially titanium alloy has been used widely in recent years.

Japanese Unexamined Patent Application Publication No. 11-216203 and Japanese Unexamined Patent Application Publication No. 2004-41376 disclose a golf club head in which the thickness on the front edge side along the face part of the sole part is increased. In FIG. 2 of Japanese Unexamined Patent Application Publication No. 11-216203, this thick part is provided throughout the whole of the front edge of the sole part, and in FIG. 4 thereof, the thick part is provided on the toe side and the heel side. In Japanese Unexamined Patent Application Publication No. 2004-41376, the thick part is provided throughout the whole of the front edge of the sole part. Also, in this publication, the golf club head is formed by a head body and a face plate welded to the head body.

BRIEF SUMMARY OF THE INVENTION

To increase the carry of a shot hit by a metallic hollow golf club head, development for increasing the rebound of the ball by utilizing the deflection (trampolining effect) of the face surface has been carried out. However, since the golf ruless governing the upper limit of the rebound coefficient have been revised, carry now has to be increased by other measures. In the case of what is called a high-rebound type golf club head utilizing the trampolining effect, although a long carry can be attained when a ball is hit by the face center, such a long carry cannot be obtained when the hit point deviates from the face center (off-center hit).

According to the golf club head described in the aforementioned Japanese Unexamined Patent Application Publication No. 11-216203 and Japanese Unexamined Patent Application Publication No. 2004-41376, the center of gravity of the head can be lowered while the balance of inertia moment is maintained. However, in FIG. 2 of Japanese Unexamined Patent Application Publication No. 11-216203 and in Japanese Unexamined Patent Application Publication No. 2004-41376, since the thick part exists throughout the whole from the toe to the heel of the front edge of the sole part, the deflection of the face part at the ball hit time is restrained as a whole, so that the carry decreases. Also, in FIG. 4 of Japanese Unexamined Patent Application Publication No. 11-216203, since the thick part is provided separately on the sole side and the heel side, the deflection of the face part at the time of off-center hit is restrained, so that the carry decreases. In addition, since the deflection of the face part at the time when a ball is hit by the face center is great, the rebound coefficient easily exceeds the limit placed by the golf rules.

An object of the present invention is to provide a golf club head capable of increasing a carry on average even if being used by an amateur golfer who is prone to hit a ball by varied hit points across the clubface.

A golf club head in accordance with the present invention is a metallic hollow golf club head comprising at least a face part, a sole part, a side part, and a crown part. In a golf club head formed by welding a face plate to a head body, a thick part is provided in the central portion in the toe-heel direction of the cross corner portion between the face part and the sole part in the golf club head, and the thick part is provided on the face plate.

In the golf club head in accordance with the present invention, which is configured as described above, since the thick part is provided only in the central portion in the toe-heel direction of the cross corner portion between the sole part and the face part, the deflection near the center of the face part at the ball hit time is restrained, and the rebound coefficient can be kept within the range of the golf rules. In the present invention, since the thick part is provided on the face plate, a marked effect that the deflection near the center of the face plate at the ball hit time is restrained is achieved. In the present invention, on the toe side and the heel side of the face part, the thick part is not provided, and therefore the deflection at the ball hit time increases. Therefore, the carry of an off-center hit increases. However, on the toe side and the heel side of the face part, the rebound coefficient is low as compared with the face center. Therefore, even if the deflection increases, the rebound coefficient does not deviate from the golf rules. According to the present invention, the difference in carry between a face center hit and an off-center hit decreases, and therefore a stable fly can be obtained.

For these reasons, even if the golf club head is used by an amateur golfer who often hits a ball with a hit point other than the center of face surface and does not attain so high a head speed, the carry increases on average. Also, the golf club head does not deviate from the golf rules. In the present invention, it is preferable that the metallic material of the face plate be a material having a Young's modulus lower than that of the metallic material of the head body, and the rebound coefficient be kept within the range of the golf rules.

The present invention is suitable for being applied to a large head having a volume of 250 cc to 460 cc.

DETAILED DESCRIPTION OF THE INVENTION

An embodiment of the present invention will now be described with reference to the accompanying drawings.

Figure 1A:
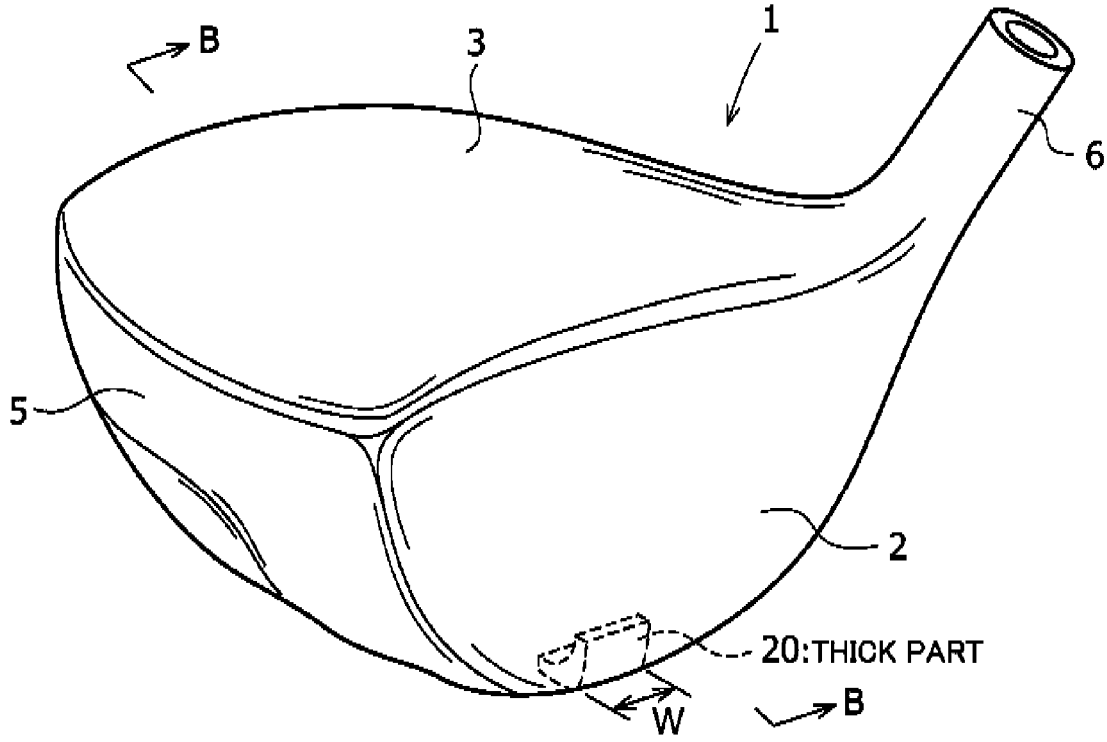
FIG. 1A is a perspective view of a golf head club in accordance with an embodiment of the present invention.
Figure 1B:
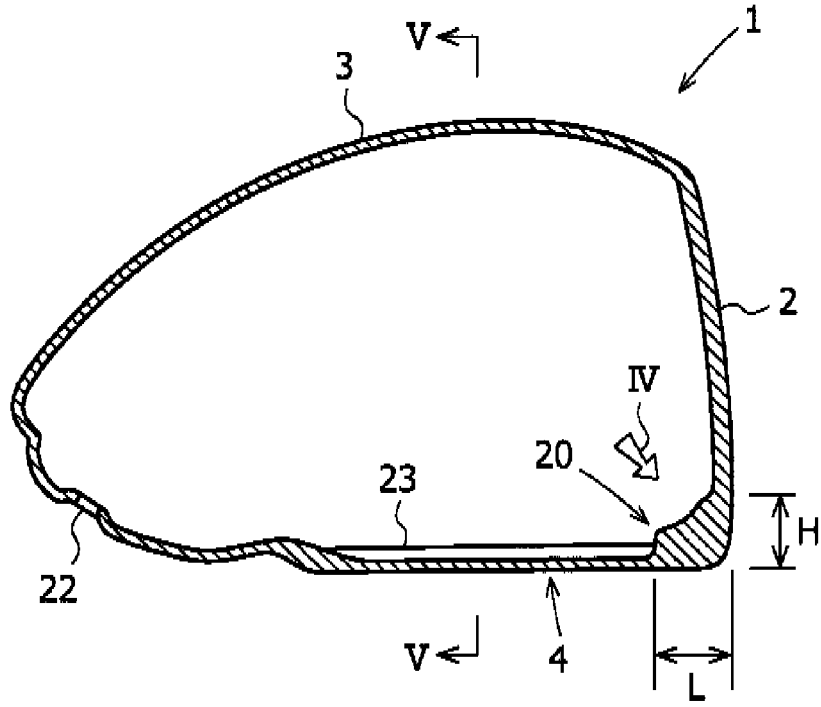
FIG. 1B is a sectional view taken along the line B-B of FIG. 1A.
Figure 2:
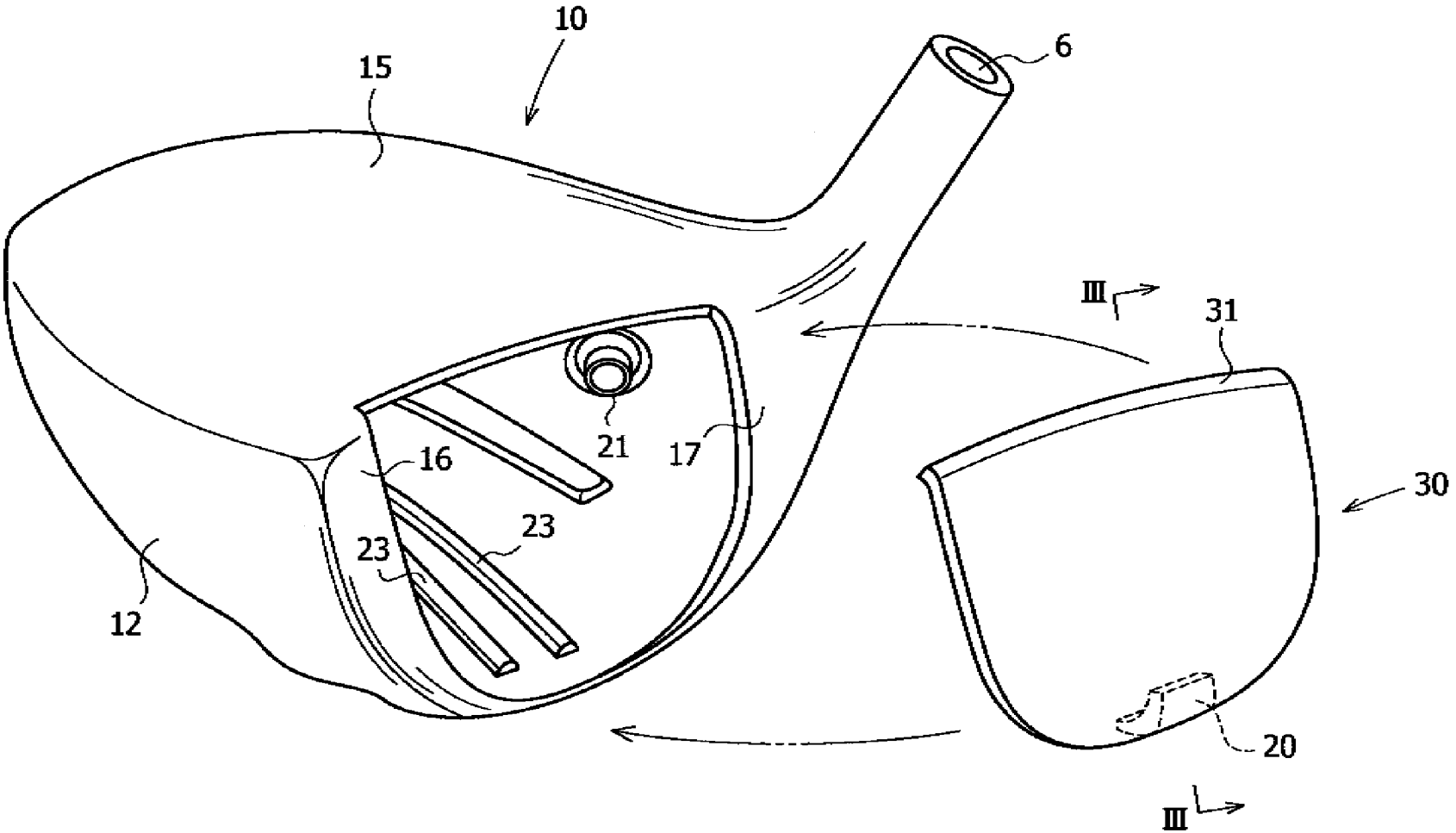
FIG. 2 is an exploded perspective view of a golf club head in accordance with an embodiment of the present invention.
Figure 3:
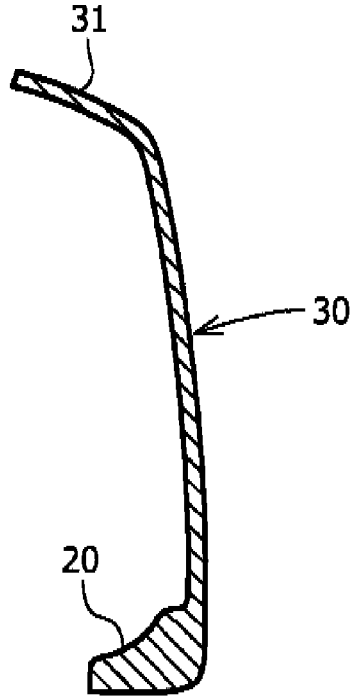
FIG. 3 is a sectional view taken along the line III-III of FIG. 2.
Figure 4:
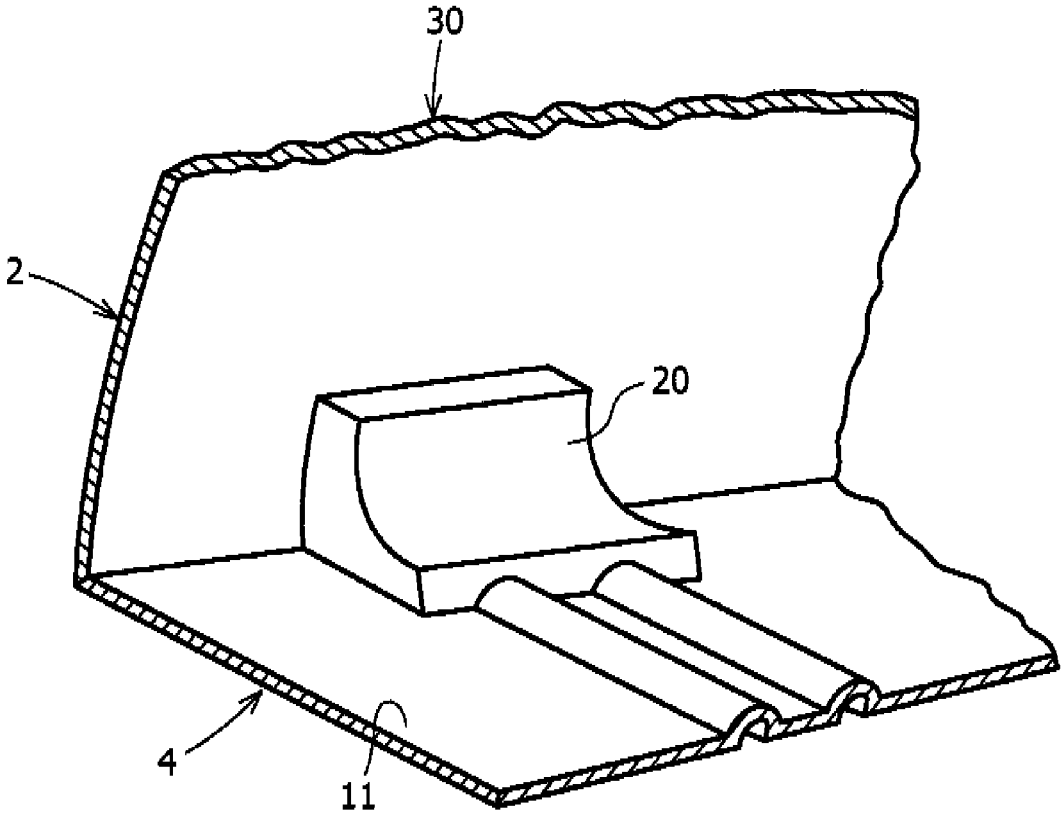
FIG. 4 is a perspective view showing a thick portion.
Figure 5:
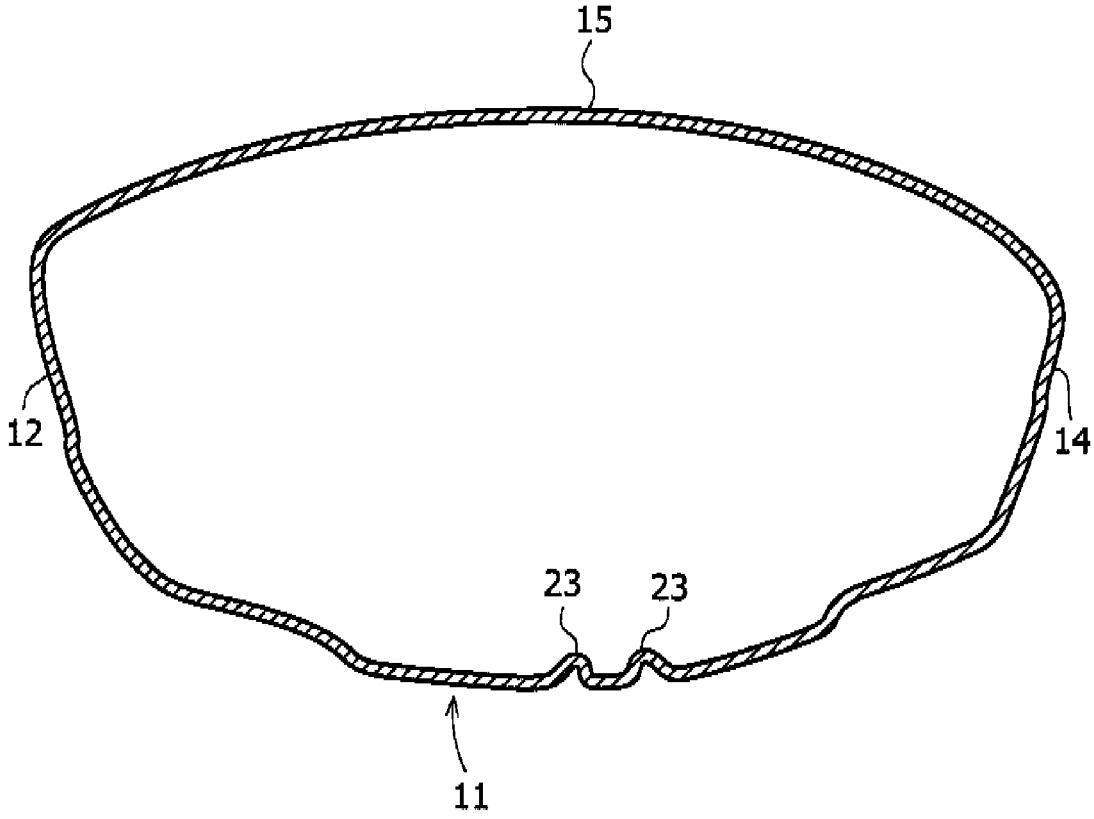
FIG. 5 is a sectional view taken along the line V-V of FIG. 1B.
Figure 6:
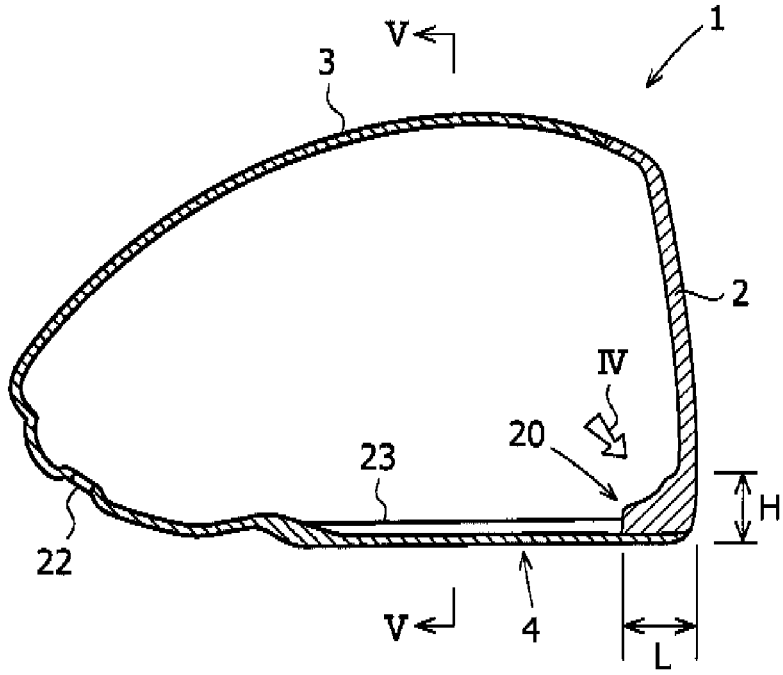
FIG. 6 is a detailed sectional view taken along the line B-B of FIG. 1A.
Figure 7:
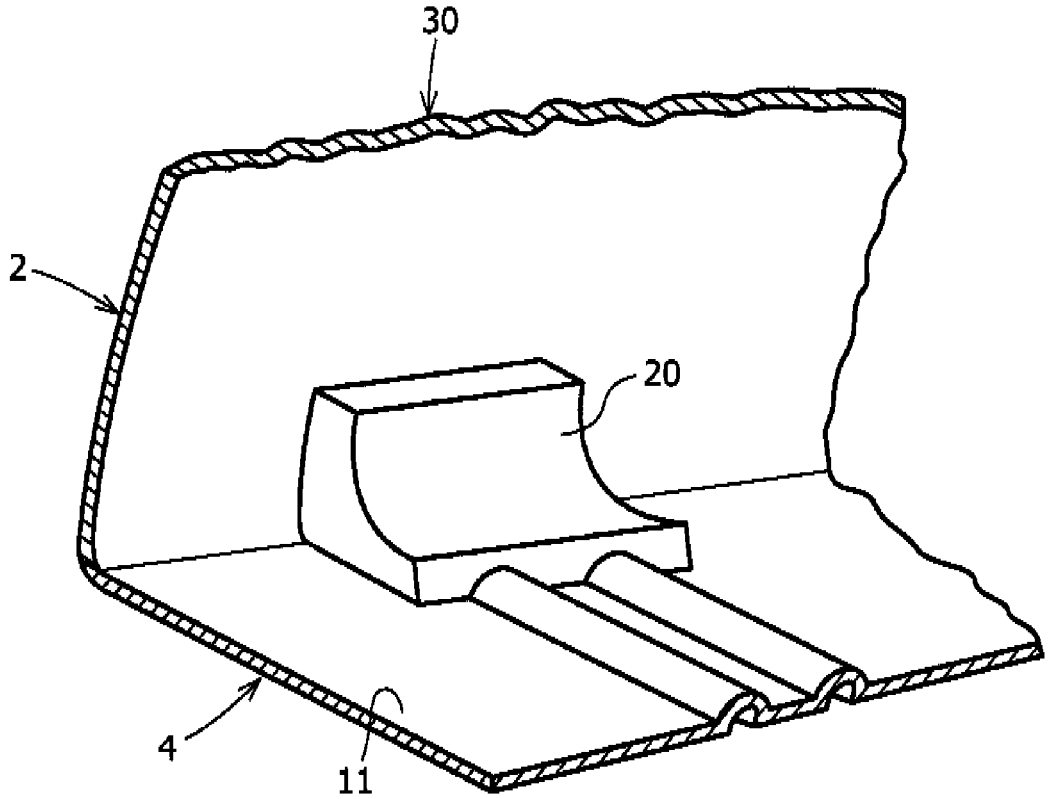
FIG. 7 is a detailed perspective view showing a thick portion.

FIGS. 1A and 1B are a perspective view and a sectional view, respectively, of a golf head club in accordance with an embodiment of the present invention, FIG. 2 is an exploded perspective view of the golf club head, FIG. 3 is a sectional view taken along the line III-III of FIG. 2, FIG. 4 is a perspective view showing a thick portion, FIG. 5 is a sectional view taken along the line V-V of FIG. 1B, FIG. 6 is a detailed sectional view taken along the line B-B of FIG. 1A, FIG. 7 is a detailed perspective view showing a thick portion.

A golf club head 1 comprises a face part 2, a crown part 3, a sole part 4, a side part 5, and a hosel part 6. In the central portion in the toe-heel direction of the cross corner portion between the face part 2 and the sole part 4 in the golf club head 1, a thick part 20 is provided. The golf club head 1 is formed by integrating a head body 10 and a face plate 30 with each other by welding such as laser welding or plasma welding. The plasma welding and laser welding have a high energy density, and therefore can provide a weld having a deep penetration and good appearance with high accuracy as compared with TIG (Tungsten Inert Gas) welding.

As clearly shown in FIGS. 2 to 5, the head body 10 carprises a bottom surface 11 forming the sole part 4, a toe elevation surface 12, a back elevation surface 13, and a heel elevation surface 14 forming the side part 5, a top surface 15 connecting with the upper edges of these elevation surfaces 12 to 14, and a toe flange 16 and a heel flange 17 each projecting to the face side from the toe elevation surface 12, the heel elevation surface 14 and the bottom surface 11, respectively. An opening is provided ranging from the front edge of the crown part 3 to the most of the face part 2. On this head body 10, the hosel part 6 is provided integrally.

Reference numerals 21 and 22 denote mounting parts for a weight (not shown) formed of a metal having a high specific gravity, such as tungsten. On the bottom surface 11, curved ridge parts 23 extending in the front and rear direction are provided.

The face plate 30 constitutes a region excluding the flanges 16 and 17 of the face part 2 (a face main portion). The upper edge of the face plate 30 is a projecting part 31 projecting to the crown part 3 side. By providing this projecting part 31, the delivery angle of ball can be made high. On the back surface of the central portion at the lower side of the face plate 30, the thick part 20 is provided integrally.

By integrating the head body 10 and the face plate 30 with each other by welding, the golf club head 1 is formed. The face plate 30 is welded to the head body 10 naturally throughout the entire periphery. It is preferable that the bottom surface of the thick part 20 be also welded to the bottom surface 11 of the head body 10. The hosel part 6 may be provided so as to reach the sole part 4 or may be provided so as not to reach the sole part 4. After welding, various finishing treatments such as grinding and painting are performed as necessary to obtain a product golf club head.

The head body 10 is a casting, so that it can be manufactured easily even if having an intricate shape.

The face plate 30 can be formed by any of casting, forging, and pressing. The thick part 20 may be formed by thinning parts other than the thick part 20 by chemical milling. The face plate 30 is provided with one or more grooves (score lines) as necessary.

In this embodiment, both of the head body 10 and the face plate 30 are formed of titanium or a titanium alloy.

As the head body 10, Ti-6Al-4V or Ti-6Al-6V-2Sn, which is an α-β type titanium alloy or Ti-8Al-1Mo-1V which is substantially an α type titanium alloy having a Young's modulus of 11,000 kgf/mm$^2$ (107.8×10$^9$ Pa) or higher is typically used. However, Ti-3Al-8V-6Cr-4Mo-4Zr or Ti-22V-4Al, which is a β type titanium alloy that is heat -treated so that the Young's modulus is in this range, can also be used.

As the face plate 30, either of the aforementioned β type titanium alloy and α-β type titanium alloy may be used. The Young's modulus of the face plate 30 is preferably lower than that of the head body 10, and specifically, it is preferably about 1000 kgf/mm$^2$ to 3000 kgf/mm$^2$ lower than the Young's modulus of the head body 10.

Next, the preferred dimensions of each part of the golf club head are explained.

The golf club head that is especially effective in applying the present invention is a large golf club head comprising an easily deflectable crown part, specifically, a golf club head (driver) having a head volume of 250 cc or larger, preferably 300 cc or larger, and further preferably 350 cc or larger. The upper limit of volume is 460 cc as specified in the golf rules.

The width W in the toe-heel direction of the thick part 20 is preferably 0.5 mm to 20 mm, especially 5 mm to 20 mm. The maximum length L of the thick part 20 from the lower edge portion of the face surface to the rear is preferably 3 mm to 35 mm, especially 10 mm to 30 mm. The maximum height H of the thick part 20 from the bottom surface of the sole part is preferably 2 mm to 20 mm, especially 5 mm to 10 mm.

The thick part 20 is preferably configured so that the front portion thereof is highest, and the height thereof decreases toward the rear as shown in the figures. Also, it is preferable that the thickness perpendicular to the face surface of the thick part 20 decrease toward the upside. Such a shape of the thick part 20 can make the deflection of face surface at the ball hit time proper.

The thickness of the sole part 4 (excluding the thick part 20) is preferably 0.5 mm to 2.0 mm, especially 0.7 mm to 1.0 mm, on average, and the thickness of the face part 2 is preferably 2 mm to 3.5 mm, especially 2.7 mm to 3.2 mm, on average. The face part 2 is preferably configured so that the thickness thereof increases gradually from the peripheral edge portion to the central portion thereof.

The thickness of the crown part 3 is preferably 0.5 mm to 1.2 mm, especially 0.7 mm to 1.0 mm, on average to easily deflect the crown part 3 at the ball hit time and to make the delivery angle of ball high. It is preferable that the thickness of the crown part 3 be approximately equal to that of the projecting part 31 of the face plate 30.

For the golf club head 1 configured as described above, since the thick part 20 is provided only in the central portion in the toe-heel direction of the cross corner portion between the sole part 4 and the face part 2, the deflection near the center of the face part 2 is restrained, and the rebound coefficient can be kept within the range of the golf rules. Also, since the thick part 20 is provided on the face plate 30, a marked effect that the deflection near the center of the face plate 30 at the ball hit time is restrained is achieved.

On the other hand, on the toe side and the heel side of the face part 2, the thick part 20 is not provided, so that the deflection at the ball hit time increases, and therefore the carry of off-center hit increases. However, on the toe side and the heel side of the face part 2, the rebound coefficient is low as compared with the face center. Therefore, even if the deflection increases, the rebound coefficient does not deviate from the golf rules.

For these reasons, even if an amateur golfer who often hits a ball with a hit point other than the center of face surface, the carry increases on average.

Also, in this embodiment, the range from the face part 2 to the crown part 3 is thin, so that the rebounding force is sufficiently high within the range of limit placed by the golf rules, and therefore the carry increases. Also, the deflection of the crown part 3 at the time when a ball is hit increases the carry.

If the width W in the toe-heel direction of the thick part 20 exceeds 20 mm, the rebounding force at the time when a ball is hit by a hit point other than the face center decreases. Also, if the width W is narrower than 0.5 mm, the thick part 20 is difficult to form.

If the maximum height H of the thick part 20 is increased excessively, the rebounding force of the face part 2 decreases. If the height H is excessively small, the rebound coefficient of face center increases excessively.

In the above-described embodiment, the cross section in the toe-heel direction of the thick part 20 is substantially rectangular. However, the thick part 20 may have a trapezoidal cross-sectional shape such that the width increases toward the downside, or may have a triangular cross-sectional shape, a pentagonal shape, a semicircular shape, or a semi-elliptical shape, though not shown.

In the above-described embodiment, most of the crown part 3 is formed by the head body 10. However, the projecting part 31 of the face plate 30 may be made longer than shown in the figure so that a wide range of crown part may be formed by the projecting part 31. In the case where at least the front edge portion of crown part is formed by the projecting part 31, the deflection of the face plate at the ball hit time is increased, by which the carry can be increased.

Preferably, a corner of the thick part 20 positioned in the back side and upper side is formed to be curved toward the face surface and the lower surface of the thick part 20.

In FIGS. 6 and 7, the bottom surface 11 of the head body 10 and the lower surface of the thick part 20 are welded together so as to abut each other, and the projecting part 31 of the face plate 30 and the face surface side edge of the top surface 15 of the head body 10 are welded together so as to abut each other.

EXAMPLE 1

A golf club head having a volume of 460 cc, which was configured as shown in the figures, was manufactured. The head body 10 was formed of (Ti-6Al-4V) α-β type titanium alloy manufactured by the investment casting process. The face plate 30 was manufactured by forging a β type titanium alloy (Young's modulus: 11,000 kgf/mm$^2$).

The thicknesses of the flange parts 16 and 17 of the head body 10 were made 2.5 mm. The thickness of the crown part was made 0.6 mm, that of the side part 0.7 mm, and that of the sole part (excluding the thick part) 0.9 mm. The thickness of the face plate 30 was made 2.8 mm. The dimensions of the thick part 20 were as follows: W=10 mm, H=10 mm, and L=5 mm.

The initial velocity of ball was measured at the time when a ball was hit by the face center and a ball was hit with the hit position being shifted 10 mm and 15 mm to the toe side at a head speed of 45 m/s using a swing robot manufactured by Miyamae Co., Ltd.

The measurement results are given in Table 1.

EXAMPLE 2

Measurement was made in the same way as Example 1 except that the thickness of face plate 30 was made 2.4 mm. The measurement results are given in Table 1.

EXAMPLE 3

Measurement was made in the same way as Example 2 except that the width W in the toe-heel direction of the thick part 20 was made 20 mm and the height H was made 20 mm. The measurement results are given in Table 1.

COMPARATIVE EXAMPLE 1

Measurement was made in the same way as Example 1 except that the thick part 20 was not provided, that is, W=0 mm. The measurement results are given in Table 1.

COMPARATIVE EXAMPLE 2

Measurement was made in the same way as Example 2 except that the width W in the toe-heel direction of the thick part 20 was made 40 mm and the height H was made 20 mm. The measurement results are given in Table 1.

TABLE 1

| | W | H | L | Face thickness | Hit point | Initial velocity (m/sec) |
|---|---|---|---|---|---|---|
| Example 1 | 10 mm | 10 mm | 5 mm | 2.8 mm | Center | 64.1 |
| | | | | | Toe 10 mm | 63.6 |
| | | | | | Toe 20 mm | 62.1 |
| Example 2 | 10 mm | 10 mm | 5 mm | 2.4 mm | Center | 64.8 |
| | | | | | Toe 10 mm | 64.5 |
| | | | | | Toe 20 mm | 63.5 |
| Example 3 | 20 mm | 20 mm | 5 mm | 2.4 mm | Center | 64.5 |
| | | | | | Toe 10 mm | 64.0 |
| | | | | | Toe 20 mm | 62.9 |
| Comparative example 1 | 0 mm | 0 mm | 2.8 mm | 2.8 mm | Center | 64.7 |
| | | | | | Toe 10 mm | 64.1 |
| | | | | | Toe 20 mm | 62.4 |
| Comparative example 2 | 40 mm | 20 mm | 5 mm | 2.4 mm | Center | 64.4 |
| | | | | | Toe 10 mm | 63.7 |
| | | | | | Toe 20 mm | 62.1 |

From Table 1, it is recognized that according to the present invention, even when a ball is hit by off-center, the initial velocity is high.

What is claimed is:

1. A golf club head being metallic and hollow, comprising at least a face part, a sole part, a side part, and a crown part, and formed by welding a face plate to a head body, wherein a lower part of the face plate is formed in a plane shape along the face part, a thick part is provided in a central portion in a toe-heel direction of a cross corner portion between the face part and the sole part in the golf club head, and the thick part is provided on the face plate so as to project from the planar lower part of the face plate rearward along a bottom surface of the head body which forms the sole part, a bottom surface of the head body forming the sole part, and a lower surface of the thick part are welded together so as to abut each other, the head body comprises the bottom surface, a toe elevation surface, a back elevation surface, and a heel elevation surface which form the side part, and flanges, each of which projects to the face side from the toe elevation surface, the heel elevation surface, and the bottom surface, respectively, and the face plate constitutes a region excluding the flanges.

2. The golf club head according to claim 1, wherein an average thickness of the face part is 2.5 mm to 3.5 mm, a length in the toe-heel direction of the thick part is 0.5 mm to 20 mm, a maximum height from a sole part bottom surface of the thick part is 2.0 mm to 20 mm, and a maximum length from a face surface to a rear of the thick part is 3 mm to 35 mm.

3. The golf club head according to claim 1, wherein a height of the thick part decreases toward a rear of the thick part.

4. The golf club head according to claim 1, wherein a metal forming the golf club head is titanium or a titanium alloy.

5. The golf club head according to claim 1 wherein a first Young's modulus of a first metal forming the face plate is lower than a second Young's modulus of a second metal forming the head body.

6. The golf club head according to claim 1, wherein a volume of the golf club head is 250 cc to 460 cc.

7. The golf club head according to claim 1, wherein a projecting part projecting to a rear of the face plate is provided in an upper part of the face plate, and the projecting part forms a part of the crown part.

8. The golf club head according to claim 1, wherein a corner of the thick part positioned in a back side and an upper side is formed to be curved toward the face surface and the lower surface of the thick part.

9. The golf club head according to claim 1, wherein the head body is an α-β type titanium alloy, and the face plate is a β type titanium alloy.

10. The golf club head according to claim 1, wherein a rib having a base end which begins at the immediate rear of the rear end of the thick part, and extending from the immediate rear of the rear end of the thick part in the front and rear direction, is provided on the bottom surface, and has a width smaller than that of the thick part and a height lower than that of the thick part.

11. The golf club head according to claim 1, where mounting parts for a weight formed of a metal having a high specific gravity are provided in the head body.

12. The golf club head according to claim 1, wherein the face place is a β type titanium alloy or an α-β type titanium alloy, and a Young's modulus of the face place is substantially 1000 $kgf/mm^2$ to 3000 $kgf/mm^2$ lower than a Young's modulus of the head body.

13. A golf club head being metallic and hollow, comprising at least a face part, a sole part, a side part, and a crown part, and formed by welding a face plate to a head body, wherein a thick part is provided in a central portion in a toe-heel direction of a cross corner portion between the face part and the sole part in the golf club head, and the thick part is provided on the face plate, a bottom surface of the head body forming the sole part, and a lower surface of the thick part are welded together so as to abut each other, the head body comprises the bottom surface, a toe elevation surface, a back elevation surface, and a heel elevation surface which form the side part, and flanges, each of which projects to the face side from the toe elevation surface, the heel elevation surface, and the bottom surface, respectively, the face plate constitutes a region of the face part excluding the flanges, a rib having a base end which begins at the immediate rear of the rear end of the thick part, and extending from the immediate rear of the rear end of the thick part in the front and rear direction, is provided on the bottom surface, and has a width smaller than that of the thick part and a height lower than that of the thick part, an average thickness of the face part is 2.5 mm to 3.5 mm, a length in the toe-heel direction of the thick part is 0.5 mm to 20 mm, a maximum height from a sole part bottom surface of the thick part is 2.0 mm to 20 mm, a maximum length from a face surface to a rear of the thick part is 3 mm to 35 mm, a height of the thick part decreases toward a rear of the thick part, and a metal forming the golf club head is titanium or a titanium alloy.

14. The golf club head according to claim 13, wherein a first Young's modulus of a first metal forming the face plate is lower than a second Young's modulus of a second metal forming the head body.

15. The golf club head according to claim 13, wherein a projecting part projecting to a rear is provided in an upper part of the face plate, and the projecting part forms a part of the crown part.

16. The golf club head according to claim 13, wherein a corner of the thick part positioned in a back side and an upper side is formed to be curved toward the face surface and the lower surface of the thick part.

17. The golf club head according to claim 13, wherein the face plate is a β type titanium alloy or an α-β type titanium alloy, and the Young's modulus of the face plate is substantially 1000 $kgf/mm^2$ to 3000 $kgf/mm^2$ lower than the Young's modulus of the head body.

18. The golf club head according to claim 13, wherein two of the ribs are provided.

19. The golf club head according to claim 18, wherein a projecting part projecting to a rear is provided in an upper part of the face plate, the projecting part forms a part of the crown part.

20. The golf club head according to claim 13, wherein the rib is a curved ridge part.

* * * * *